United States Patent [19]

Rodriguez

[11] 4,332,497

[45] Jun. 1, 1982

[54] COMBINATION TOOTHBRUSH AND TOOTHPASTE DISPENSER

[76] Inventor: Gonzalo C. Rodriguez, Avenida Los Naranjos 3, La Florida, Caracas, Venezuela

[21] Appl. No.: 123,882

[22] Filed: Feb. 22, 1980

[51] Int. Cl.[3] ..... A46B 11/04

[52] U.S. Cl. ..... 401/154; 401/286; 401/184

[58] Field of Search ..... 401/154, 286, 287; 401/134, 157, 158, 183

[56] References Cited

U.S. PATENT DOCUMENTS

| | | | |
|---|---|---|---|
| 844,646 | 2/1907 | Bahr | 401/158 |
| 1,049,863 | 1/1913 | Happle | 401/286 |
| 1,250,454 | 12/1917 | Heard | 401/154 |
| 1,502,971 | 7/1924 | Wallace | 401/158 |
| 1,525,164 | 2/1925 | Beadles | 401/154 |
| 1,706,751 | 3/1929 | Risk | 401/154 |
| 1,851,257 | 3/1932 | Boeuf | 401/158 |
| 2,238,214 | 4/1941 | Dole | 401/154 |
| 2,602,424 | 7/1952 | Morgan | 401/154 |
| 3,284,838 | 11/1966 | Bieganowski | 401/286 |
| 3,549,268 | 12/1970 | Casselman | 401/154 |
| 4,199,270 | 4/1980 | Tomasini | 401/183 |

FOREIGN PATENT DOCUMENTS

| | | | |
|---|---|---|---|
| 349626 | 6/1937 | Italy | 401/154 |
| 455482 | 3/1950 | Italy | 401/154 |
| 358356 | 12/1961 | Switzerland | 401/154 |
| 149315 | 2/1921 | United Kingdom | 401/154 |

*Primary Examiner*—Clyde I. Coughenour
*Attorney, Agent, or Firm*—Browdy and Neimark

[57] ABSTRACT

Disclosed is a fountain toothbrush and a hollow handle, which are connected together to dispense toothpaste from a reservoir in the handle to the bristles of the toothbrush. Within the handle is a flexible tube which is secured at one end of the handle to prevent rotation and secured to a rotatable knob at the other end of the handle for rotation. Extending from the handle and through the toothbrush to the bristles is a conduit for extruding toothpaste to the bristles when the knob is rotated to twist the flexible tube thereby dispensing paste from the reservoir. Also provided is a cover for the toothbrush, which includes a stopper for sealing the conduit in the toothbrush.

5 Claims, 6 Drawing Figures

COMBINATION TOOTHBRUSH AND TOOTHPASTE DISPENSER

FIELD OF THE INVENTION

This invention relates to a fountain toothbrush with a reservoir of toothpaste in the handle and a conduit to dispense the toothpaste to the bristles and, more particularly, to an improved dispensing structure.

BACKGROUND OF THE INVENTION

The pattern of life of most working people does not, during working hours, provide access to their own bathroom, where supplies are kept for cleaning their teeth. During working hours most working people do not brush their teeth, because heretofore there has been no convenient way to carry a toothbrush and toothpaste. Prior art toothbrushes with their toothpaste supply have not been widely accepted either because of their size, or their mechanical dispensers do not operate properly, or because there has not been a dispenser with a sealing means to prevent the paste from hardening.

Some examples of the prior art fountain toothbrushes are shown in U.S. Pat. Nos. 3,408,150; 3,864,047; 3,995,648 and 4,149,552. From the above list of prior art patents it is well known to employ a plunger or follower to advance the toothpaste within a reservoir in the toothbrush handle. Likewise, it is well known to screw-thread a fountain toothbrush on the end of a tube of toothpaste and dispense the paste by squeezing the tube. Each of these types of fountain toothbrushes has at least one of the above mentioned disadvantages, which has been found to be unacceptable.

SUMMARY

It is therefore an object of the present invention to overcome deficiencies of the prior art, such as indicated above; another object is to provide for improved ease in effecting dental hygiene; a further is to provide an improved toothpaste dispenser; and yet another object is to provide a fountain toothbrush which does not have a plunger or follower, or which connects to a toothpaste tube, while being simple to operate and hygienic.

A fountain toothbrush according to the invention includes a stem having a conduit extending therethrough, the stem having a fastening means at one end thereof. Integral with the stem is a brush head on the opposite end of the fastening means. The brush head includes bristles and a conduit running from the conduit in the stem to the bristles.

There is a hollow handle having a fastening means at one end for mating with the fastening means on the stem. Within the hollow handle is a reservoir, which has a flexible liner secured to the inside end of the handle with the fastening means, the flexible liner is connected to a knob on the other end of the handle. The flexible liner is closed by the knob on one end, therefore by manual rotation of the knob the liner is twisted, forcing toothpaste out the open end.

The fountain toothbrush has a cover, which fits over the brush head. The cover includes a pivotal side, which pivots open to insert or remove the toothbrush. On the inside surface of the pivotal side is a projection, which aligns with the conduit in the brush head to seal the conduit and the toothpaste therein hygienically.

The features of a fountain toothbrush constructed according to the present invention permit each of the elements to be injection molded, thus affording the unique advantage of low cost production. Other advantages of the various features of the present invention will become apparent to those skilled in the art from the following description, taken in conjunction with the accompanying drawings.

DESCRIPTION OF THE PREFERRED EMBODIMENT

Figure 1:
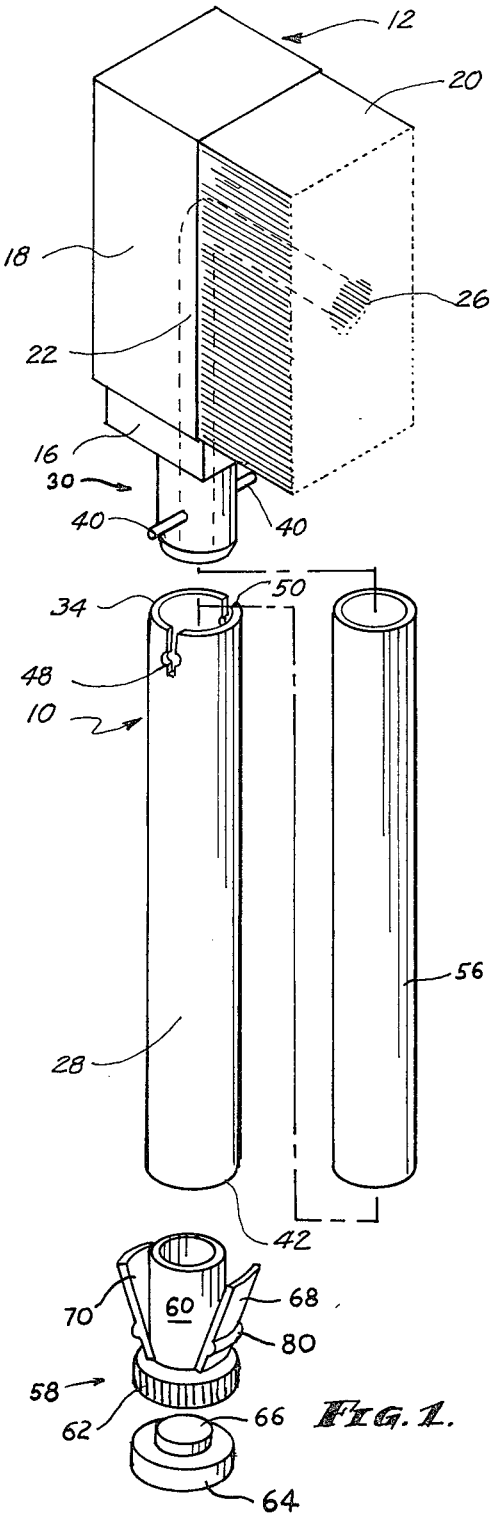
FIG. 1 is an exploded view of the fountain toothbrush of the present invention, with the various parts shown separately.
Figure 6:
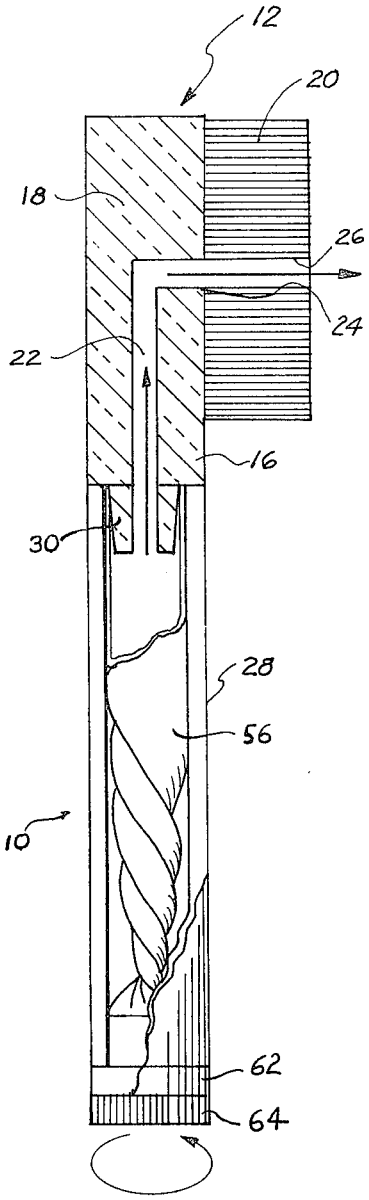
FIG. 6 is a schematic view, showing the operation of the twisting dispenser of a fountain toothbrush of the present invention.

Referring to the drawings, particularly FIGS. 1 and 6, there is shown an improved combined fountain toothbrush and toothpaste reservoir 10. The fountain toothbrush 12 is made out of a durable material, such as molded thermoplastic, for example nylon or polyethylene. In the embodiment, illustrated toothbrush 12 is formed in the generally rectangular shape shown, although such shape may be more streamlined, with curved or rounded edges, as long as it provides a stem 16 and brush head portion 18 with bristles 20, to be described hereinafter.

Fountain toothbrush 12 is provided with a longitudinal conduit 22 which extends through the stem 16 to an opening 24 in the brush head portion 18. The opening 24 is located in the center of the bristles 20, as shown in FIG. 1, whereby toothpaste forced through conduit 22 is dispensed to the bristles 20. There is an area 26 formed by the bristles surrounding opening 24 which directs the toothpaste to the surface of the bristles.

Figure 3:
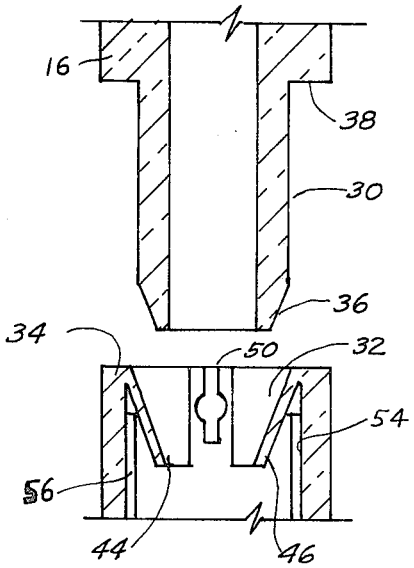
FIG. 3 is an exploded cross sectional view of connecting elements for a fountain toothbrush of the present invention.

A hollow handle 28 made out of a rigid plastic or metal or similar durable material engages the stem 16 of the toothbrush 12 to communicate with the conduit 22. A coupling formed of a male coupling element 30 on the end of stem 16 is inserted in a female coupling element 32 integrally molded on a first end 34 of the hollow handle 28. The male coupling element 30, best shown in FIGS. 1 and 3, is integrally molded with the stem 16 and has a cylindrical shape with a tapered end 36. The thickness of the wall of the male coupling element 30 is thinner than the thickness of the wall of the stem 16 such that the difference between the two wall thicknesses provides a shoulder 38 which is engaged by the hollow handle 28. Projecting radially outward on opposite sides of the male coupling element 30 are two lugs 40.

Figure 4:
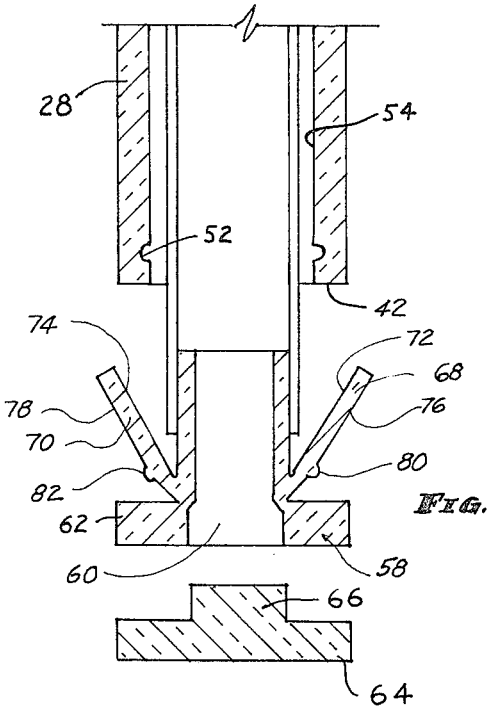
FIG. 4 is a cross sectional view of a clamping element prior to clamping a flexible liner of a fountain toothbrush of the present invention.

Hollow handle 28 has a second end 42 opposite the first end 34. First end 34 has downwardly extending internal flaps 44 and 46 and keyed slots 48 and 50 which form the female coupling element 32. The flaps 44 and 46 frictionally engage the surface of the male coupling element 30, and keyed slots 48 and 50 grip lugs 40 to lock the male coupling element 30. Flaps 44 and 46 which are integrally molded on the first end 34 of the hollow handle 28 have thin walls to make them somewhat flexible. The second end 42 of the hollow handle has an internal annular groove 52 on the inside wall 54, as shown in FIG. 4. The purpose of the annular groove 52 will be explained.

A flexible plastic liner 56 is slid inside the hollow handle 28 to form a reservoir for the toothpaste. The plastic liner 56 is a cylindrical tube made of a thin plastic without a plastic memory to return to the original cylindrical shape.

Plastic liner 56 is clamped on a manually rotatable knob 58 which is inserted in the second end 42 of the hollow handle 28. The rotatable knob 58 consists of a fill tube 60 and a knurled knob end 62. A cap 64 with a threaded plug 66 seals the fill tube 60. A pair of clamping members 68 and 70 are integrally molded on the fill tube 60, as shown in FIG. 4. The clamping members 68 and 70 are arcuate in cross section to conform to the outside diameter of the fill tube 60 so that when pressed against the fill tube the inside surfaces 72 and 74 of the clamping member wrap around the fill tube. On the outside surfaces 76 and 78 of clamping members 68 and 70 are protrusions 80 and 82 which engage the annular groove 52 of the second end 42 of the hollow handle 28 to lock the knob to the handle and to permit rotation of knob 58.

Figure 5:
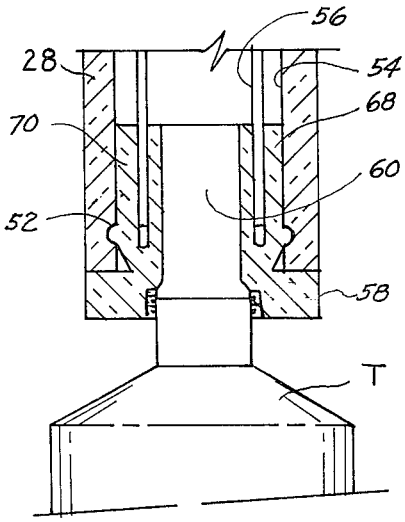
FIG. 5 is a cross sectional view of a clamping element clamping a flexible liner of a toothbrush of the present invention.

To assemble the combined fountain toothbrush, hollow handle, and reservoir 10 the plastic liner 56 is placed over the fill tube 60 and the clamping members 68 and 70 are squeezed against the fill tube 60 to pinch the plastic liner between the fill tube and the clamping members as shown in FIGS. 4 and 5. The plastic liner 56 is inserted in the hollow handle 28 with the upper end of the liner sliding inbetween the flaps 44 and 46 and the inside wall 54 of the hollow handle 28. The protrusions 80 and 82 on the clamping members 68 and 70 snap into annular groove 52 of the hollow handle 28 as explained. Next the male coupling element 30 is inserted in the female coupling element 32 of the hollow handle 28, which forces the flaps 44 and 46 outward to pinch the upper end of the liner 56 against the inside wall 54 of the handle preventing rotation of the upper end of the liner. The fountain toothbrush 12 is locked to the hollow handle 28 by the mechanical engagement of lugs 40 in keyed slots 48 and 50.

The operation of the fountain toothbrush and reservoir 10 is as follows: Cap 64 is removed from the knob 58 and a commercial toothpaste tube T is threaded into the end of fill tube 60. The plastic liner 56 is filled with toothpaste by squeezing tube T. Once the liner 56 or reservoir is filled the cap 64 is replaced to seal the fill tube 60. Toothpaste is dispensed to the bristles by rotating the knob 58 which in turn twists the liner 56, since it is held against rotation by the flaps 44 and 46. Toothpaste will continue to be dispensed by further twisting the liner 56, as shown in FIG. 6. When the knob 58 is not rotated there is no pressure to dispense toothpaste from the liner. As is clear to those skilled in the art, the reservoir may be refilled by rotating knob 58 in a direction opposite to that used for dispensing, thereby straightening out plastic liner 56 prior to filling by squeezing the toothpaste tube P.

Figure 2:
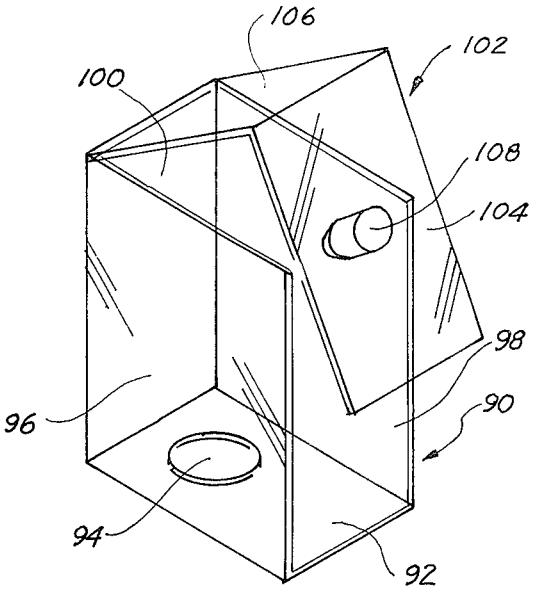
FIG. 2 is a perspective view of a fountain toothbrush cover of the present invention.

A cover 90 is shown in FIG. 2 for protecting the head portion of the fountain toothbrush when not in use. The cover 90 is made of a plastic material and includes a bottom wall 92 with an opening 94 of size adapted to receive the handle 28, a pair of sidewalls 96 and 98 and a back wall 100. These walls are secured to each other along their edges as shown to provide an open top and front. An L-shaped closure 102, having a front wall 104 and a top wall 106, is hinged to the back wall 100 for pivotal movement to open and close the cover 90. Mounted on the front wall 104 of the closure 102 is a stopper 108, which is positioned to project into the opening 26 of the brush head portion 18 to seal the conduit 22 when the brush is not in use.

While only one embodiment of the invention has been disclosed, it will be understood that various changes may be made without departing from the spirit of the invention, therefore the claims should be looked to for the scope of the invention:

What is claimed:

1. A combination fountain toothbrush and toothpaste reservoir comprising:

a fountain toothbrush having a brush head portion and a stem means having a male coupling means;

a hollow handle having a first end and a second end and having female coupling means on said first end to engage the male coupling means of said stem means;

a conduit means extending through said fountain toothbrush, communicating with said hollow handle;

an elongated flexible tube reservoir means having a first open end for discharging toothpaste to said brush head and a second open end for receiving toothpaste to fill said reservoir, wherein said reservoir means is disposed in said hollow handle, said first open end being secured to said first end of said hollow handle; and twisting means, connectable to said second end of said hollow handle, for twisting said flexible tube reservoir means to dispense toothpaste therefrom, said twisting means comprising a rotatable knob and a clamping means for clamping the second end of said flexible tube reservoir means to said rotatable knob;

wherein said female coupling means of said hollow handle includes at least one pair of downwardly facing flexible flap means for clamping the first end of said flexible tube reservoir means between said flap means and the internal wall of said hollow handle when said male coupling means is inserted into said female coupling means.

2. A combination fountain toothbrush and toothpaste reservoir comprising:

a fountain toothbrush having a brush head portion and a stem means having a male coupling means;

a hollow handle having a first end and a second end and having female coupling means on said first end to engage the male coupling means of said stem means;

a conduit means extending through said fountain toothbrush, communicating with said hollow handle;

an elongated flexible tube reservoir means having a first open end for discharging toothpaste to said brush head and a second open end for receiving toothpaste to fill said reservoir, wherein said reservoir means is disposed in said hollow handle, said first open end being secured to said first end of said hollow handle; and twisting means, connectable to said second end of said hollow handle, for twisting said flexible tube reservoir means to dispense toothpaste therefrom, said twisting means comprising a rotatable knob and a clamping means including an inner male portion and a flexible arcuate tab means for coupling the second end of said flexible tube reservoir means between said tab means and the external wall of said inner male portion when said twisting means male portion and tab means are inserted into said hollow handle.

3. A combination fountain toothbrush and toothpaste reservoir as in claim 1 or claim 1, wherein said conduit means is provided with an opening in said brush head portion, and including cover means for receiving and protecting said head portion when not in use, and stopper means carried by said cover means, said stopper means being positioned and arranged for closing said opening in said brush head portion to seal said conduit when the toothbrush is positioned within said cover means.

4. A combination fountain toothbrush and toothpaste reservoir as in claim 2 wherein said arcuate clamping members comprise external protrusions and said hollow handle includes in its second end internal annular grooves for axially locking said knob rotatably within said hollow handle.

5. A combination fountain toothbrush and toothpaste reservoir as in claim 3 wherein said rotatable knob includes clamping means for said flexible tube reservoir, including a fill tube means for connection to commercial toothpaste tubes for filling, and arcuate clamping means for locking engagement with said hollow handle and for sealingly securing said second end of said reservoir around said fill tube means, where rotation of said knob will twist said flexible tube reservoir to dispense toothpaste to said fountain toothbrush.

* * * * *

UNITED STATES PATENT AND TRADEMARK OFFICE

CERTIFICATE OF CORRECTION

PATENT NO. : 4,332,497

DATED : June 1, 1982

INVENTOR(S) : Gonzalo C. Rodriguez

It is certified that error appears in the above-identified patent and that said Letters Patent is hereby corrected as shown below:

Column 5, Claim 3, line 2, "1" second occurrence should read -- 2 --.

Column 6, Claim 5, should be deleted in its entirety

Signed and Sealed this

*Thirtieth* Day of *August 1983*

[SEAL]

*Attest:*

GERALD J. MOSSINGHOFF

*Attesting Officer*

*Commissioner of Patents and Trademarks*